US007127777B2

(12) United States Patent
Chiang

(10) Patent No.: US 7,127,777 B2
(45) Date of Patent: Oct. 31, 2006

(54) NON-GLASS-CUTTING AND ADJUSTABLE AUTOMATIC POSITIONING HINGE FOR A GLASS DOOR

(76) Inventor: Fanny Chiang, 11 Fl.-4, No. 16, Chungming S. Rd., West Dist., Taichung (TW)

( * ) Notice: Subject to any disclaimer, the term of this patent is extended or adjusted under 35 U.S.C. 154(b) by 150 days.

(21) Appl. No.: 11/032,713

(22) Filed: Jan. 10, 2005

(65) Prior Publication Data

US 2006/0150368 A1 Jul. 13, 2006

(51) Int. Cl.
*E05D 5/02* (2006.01)

(52) U.S. Cl. ..... 16/252; 16/241; 16/245; 16/235; 16/382

(58) Field of Classification Search ..... 16/252, 16/235, 238, 240, 241, 245, 246, 382, 334; 49/397–399, 381; 160/199, 206, 208, 210, 160/213; 4/556, 557, 607, 614
See application file for complete search history.

(56) References Cited

U.S. PATENT DOCUMENTS

| | | | | |
|---|---|---|---|---|
| 4,956,954 | A | 9/1990 | Horgan, Jr. | |
| 4,977,642 | A * | 12/1990 | Marinoni | 16/257 |
| 5,203,115 | A | 4/1993 | Marinoni | |
| 5,283,978 | A | 2/1994 | Horgan, Jr. | |
| 5,297,313 | A * | 3/1994 | Brin | 16/252 |
| 5,483,770 | A | 1/1996 | Marinoni | |
| 5,867,869 | A * | 2/1999 | Garrett et al. | 16/252 |
| 6,519,811 | B1 * | 2/2003 | Cheng | 16/252 |
| 6,526,627 | B1 * | 3/2003 | Chiang | 16/284 |
| 6,704,966 | B1 * | 3/2004 | Kao | 16/252 |
| 6,766,561 | B1 * | 7/2004 | Cheng | 16/235 |
| 6,826,870 | B1 | 12/2004 | Chiang | |
| 6,966,150 | B1 * | 11/2005 | Chiang | 49/388 |
| 7,010,832 | B1 * | 3/2006 | Chen | 16/252 |
| 2002/0116787 | A1 * | 8/2002 | Miller et al. | 16/252 |
| 2005/0125949 | A1 * | 6/2005 | Lin | 16/248 |

FOREIGN PATENT DOCUMENTS

| | | | |
|---|---|---|---|
| DE | 19700619 | A1 * | 7/1998 |
| DE | 19829503 | A1 * | 1/2000 |
| DE | 10150916 | A1 * | 7/2002 |
| EP | 599254 | A1 * | 6/1994 |
| EP | 792990 | A1 * | 9/1997 |
| EP | 867586 | A2 * | 9/1998 |
| FR | 2221018 | A * | 11/1974 |

* cited by examiner

*Primary Examiner*—Chuck Y. Mah
(74) *Attorney, Agent, or Firm*—patenttm.us; James H. Walters

(57) ABSTRACT

A non-glass-cutting and adjustable hinge has a doorframe mount, a securing base, a spindle, a door bracket assembly, at least one positioning device and an adjusting assembly. The securing base is securely attached to the doorframe mount. The door bracket assembly is pivotally connected to the securing base with the spindle to attach to a glass panel and has a door bracket, two resilient plates, a pushing plate and multiple pushing bolts. The door bracket is constructed of a single body and has an engaging recess and multiple pushing threaded holes. The resilient plates are mounted inside the engaging recess and located respectively at two sides of the engaging recess. The pushing plate is mounted inside the engaging recess and abuts against one of the resilient plates. The pushing bolts are screwed respectively into the pushing threaded holes and push against the pushing plate.

9 Claims, 7 Drawing Sheets

NON-GLASS-CUTTING AND ADJUSTABLE AUTOMATIC POSITIONING HINGE FOR A GLASS DOOR

BACKGROUND OF THE INVENTION

1. Field of the Invention

The present invention relates to an automatic positioning hinge, and more particularly to a non-glass-cutting and adjustable automatic positioning hinge for a glass door and one that is easily and conveniently assembled with the glass door.

2. Description of Related Art

A glass door in a doorway system comprises a glass panel, a doorframe and two conventional hinges. The glass panel is pivotally mounted in the doorframe with the hinges. However, exact alignment of the glass panel with the doorframe is important because the glass door will not close completely when the glass panel is not aligned exactly with the doorframe. Therefore, an adjustable hinge is provided to accurately install the glass panel in the doorframe with the hinges.

However, to assemble a conventional adjustable hinge onto the glass panel of the glass door, a notch must firstly be defined in the glass panel to engage with the conventional adjustable hinge. Therefore, to install conventional adjustable hinge onto the glass panel is inconvenient and troublesome, specifically to that the glass panel is always made of tempered glass so that to define a notch in a tempered glass is very difficult and costly.

To overcome the shortcomings, the present invention provides a non-glass-cutting and adjustable automatic positioning hinge for a glass door to mitigate or obviate the aforementioned problems.

SUMMARY OF THE INVENTION

The main objective of the invention is to provide a non-glass-cutting and adjustable automatic positioning hinge for a glass door and that is convenient in assembling with the glass door. The adjustable automatic positioning hinge has a doorframe mount, a securing base, a spindle, a door bracket assembly, at least one positioning device and an adjusting assembly. The securing base is securely attached to the doorframe mount. The spindle is mounted in the securing base and has an exterior surface with a middle portion. The door bracket assembly is pivotally connected to the securing base with the spindle to attach to a glass panel of the glass door. The door bracket assembly has a door bracket, two resilient plates, a pushing plate and multiple pushing bolts. The door bracket is constructed of a single body and has an engaging recess and multiple pushing threaded hole. The engaging recess is defined in the door bracket to hold the glass panel and has two sides. The resilient plates are mounted inside the engaging recess and located respectively at the sides of the engaging recess. The pushing plate is mounted inside the engaging recess and abuts against one of the resilient plates. The pushing bolts are screwed respectively into the pushing threaded holes and push against the pushing plate. The at least one positioning device is mounted between the securing base and the spindle to position the glass panel in a specific position. The adjusting assembly is mounted between the door bracket assembly and the spindle and has a holding device and an adjusting device. The holding device is mounted on the exterior surface of the spindle. The adjusting device is mounted in the door bracket and fits with the holding device on the spindle.

Other objectives, advantages and novel features of the invention will become more apparent from the following detailed description when taken in conjunction with the accompanying drawings.

DETAILED DESCRIPTION OF PREFERRED EMBODIMENT

Figure 1:
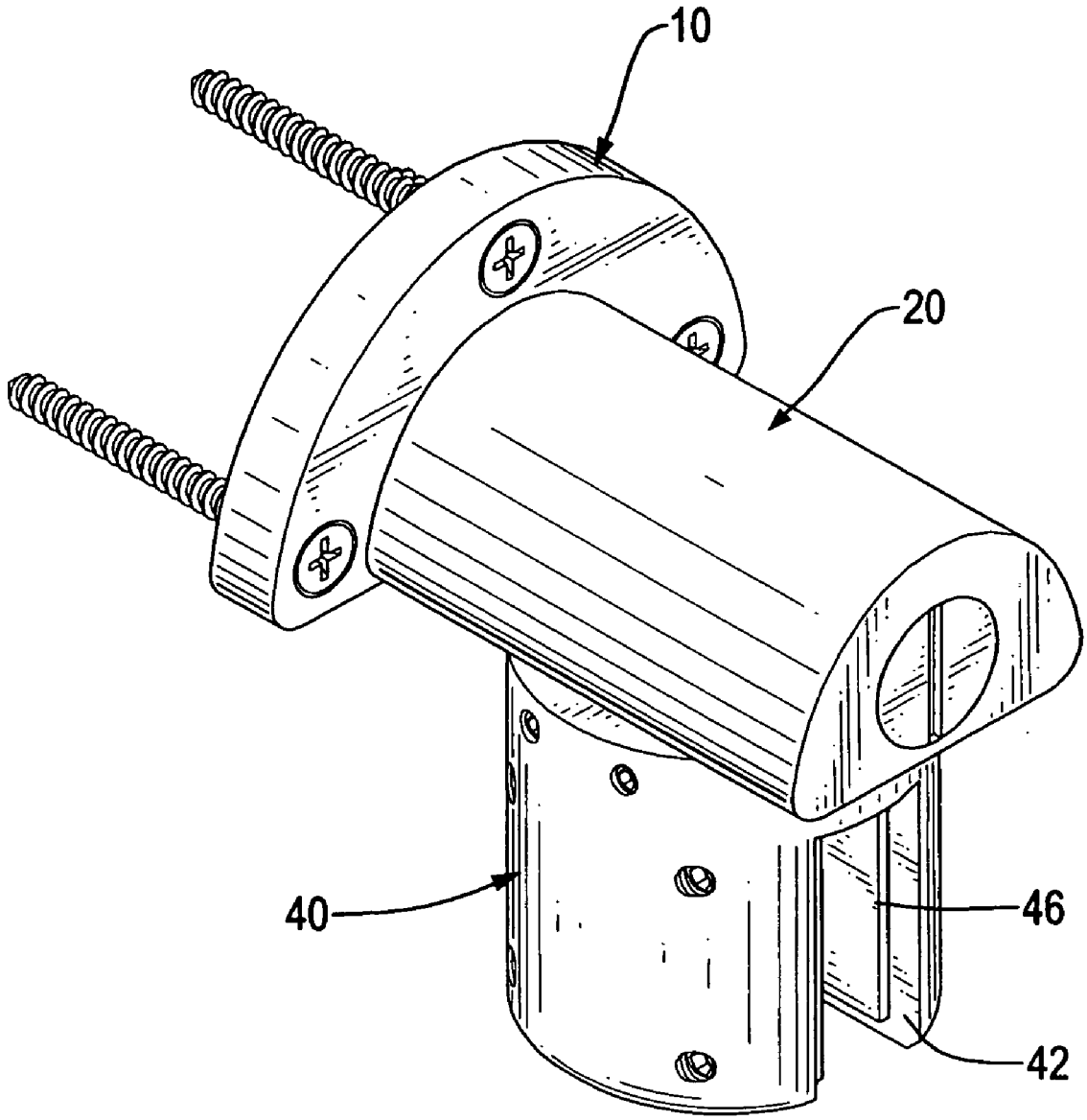
FIG. 1 is a perspective view of a non-glass-cutting and adjustable hinge in accordance with the present invention.
Figure 2:
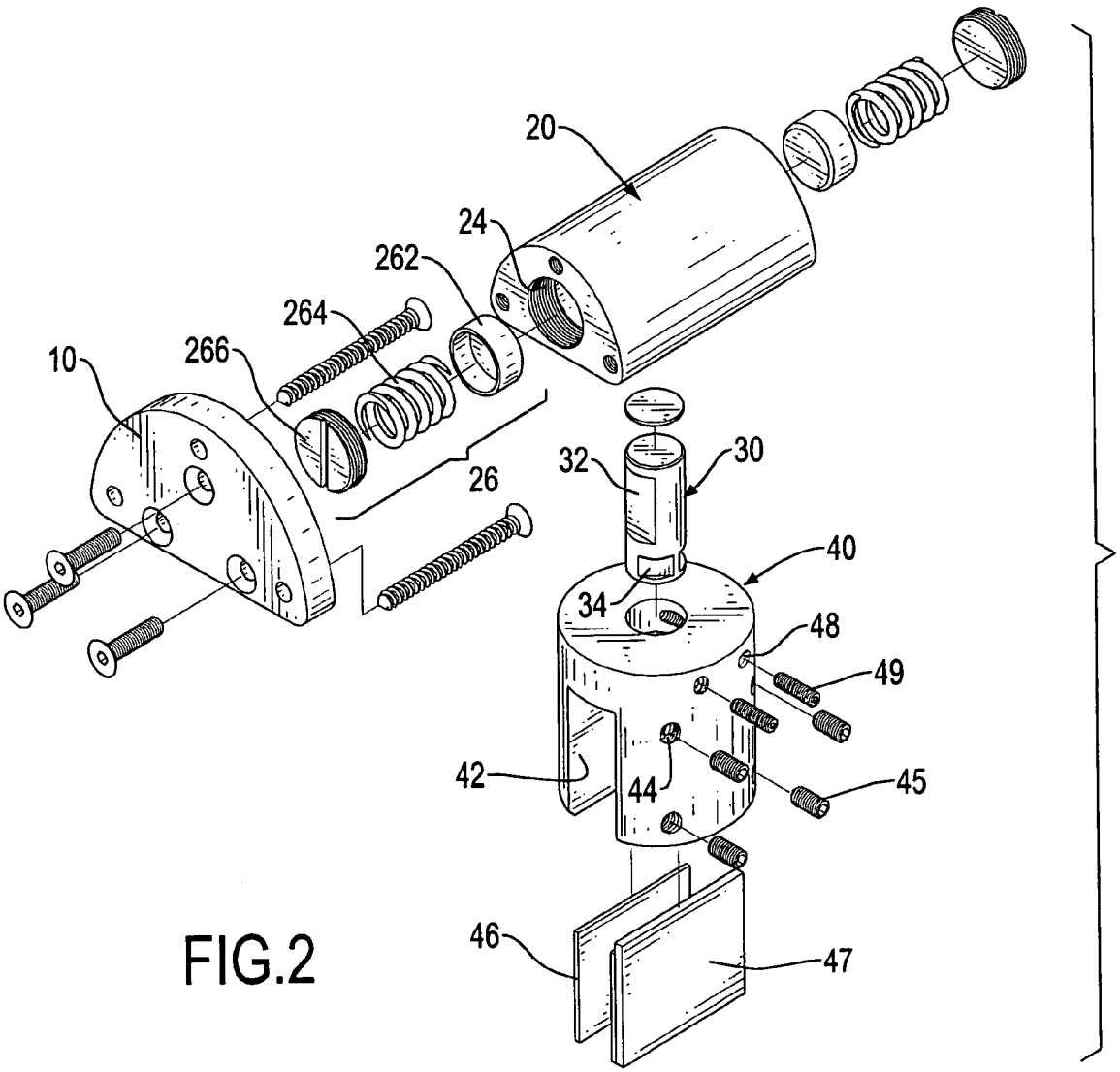
FIG. 2 is an exploded perspective view of the adjustable hinge in FIG. 1.
Figure 3:
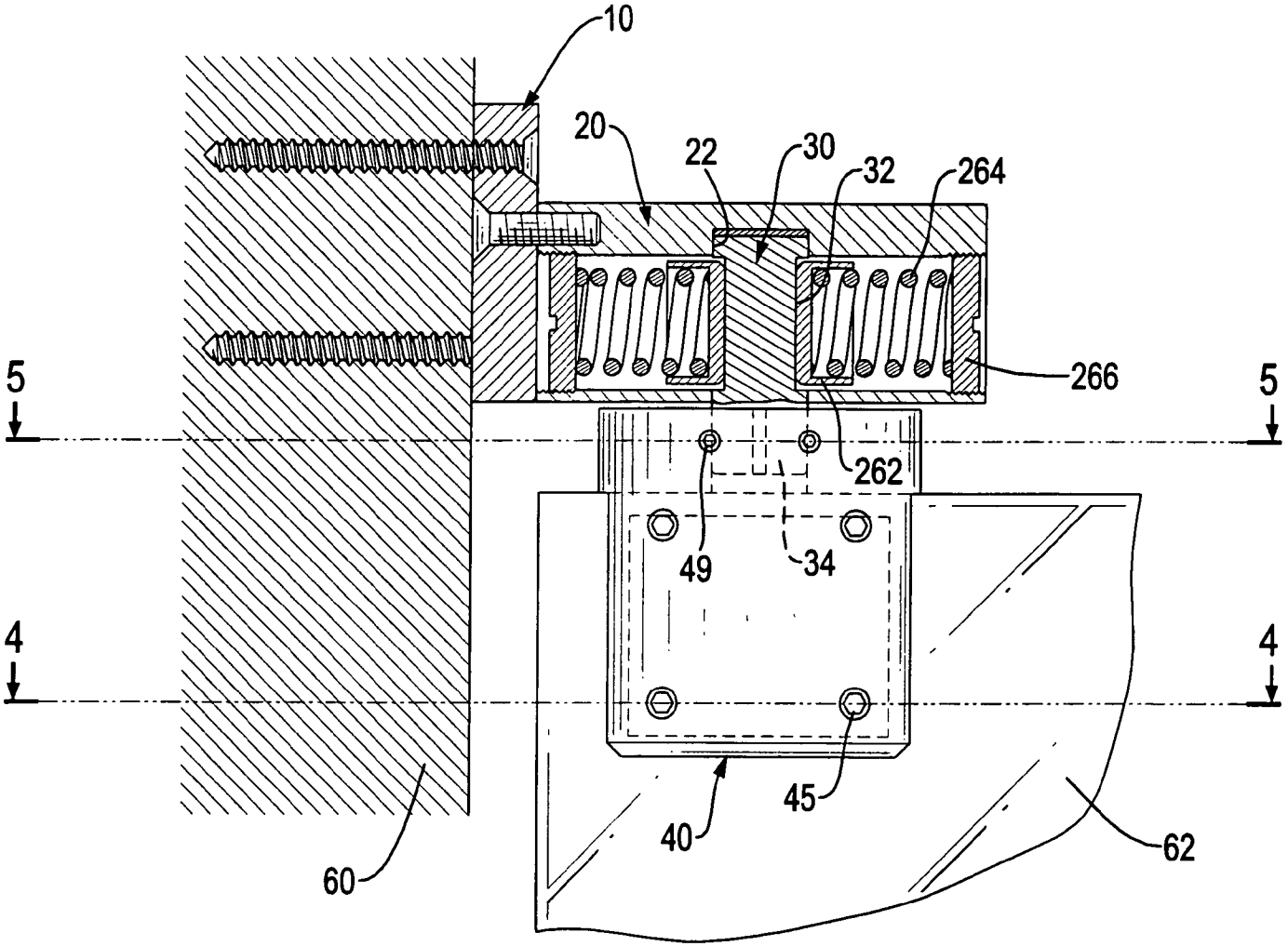
FIG. 3 is a side view in partial section of the glass door with the adjustable hinge in FIG. 1.

With reference to FIGS. 1 to 3, a non-glass-cutting and adjustable automatic positioning hinge for a glass door in accordance with the present invention comprises a doorframe mount (10), a securing base (20), a spindle (30), a door bracket assembly, at least one positioning device (26) and an adjusting assembly. The doorframe mount (10) is securely attached to a doorframe (60) of the glass door. The securing base (20) is securely attached to the doorframe mount (10). A spindle hole (22) is defined in the securing base (20) to rotatably hold one end of the spindle (30). The spindle (30) has one end rotatably mounted in the spindle hole (22) and has an exterior surface.

Figure 4:
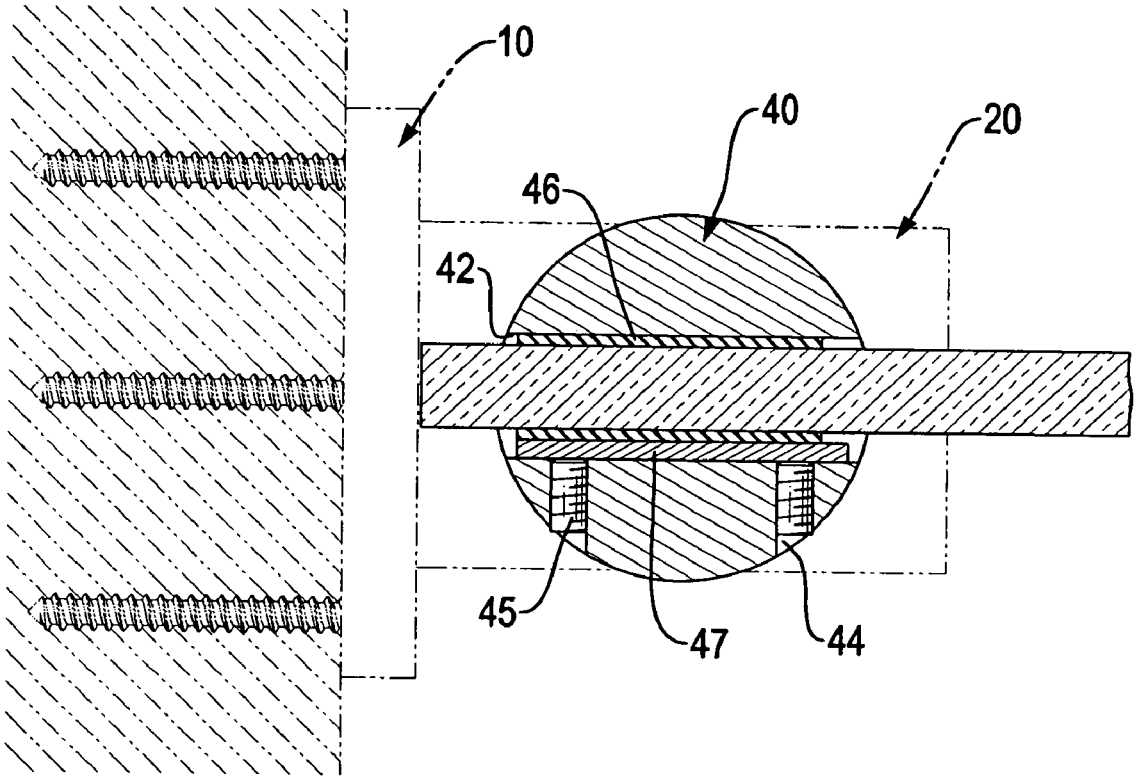
FIG. 4 is a top plan view in partial section of a glass door with the adjustable hinge along line 4—4 in FIG. 3.

With further reference to FIG. 4, the door bracket assembly is pivotally connected to the securing base (20) with the spindle (30) to attach to a glass panel (62) of the glass door. The door bracket assembly comprises a door bracket (40), two resilient plates (46), a pushing plate (47) and multiple pushing bolts (45). The door bracket (40) is constructed of a single body and has an engaging recess (42) and multiple pushing threaded holes (44). The engaging recess (42) is defined in the door bracket (40) to hold the glass panel (62) and has two sides. The pushing threaded holes (44) are defined in the door bracket (40) and communicate with the engaging recess (42). The resilient plates (46) are mounted inside the engaging recess (42) and located respectively at the sides of the engaging recess (42). The pushing plate (47) is mounted inside the engaging recess (42), corresponds to the pushing threaded holes (44) and abuts against one of the resilient plates (46). The pushing bolts (45) are screwed respectively into the pushing threaded holes (44) and push against the pushing plate (47).

To assemble the hinge to the glass door, the doorframe mount (10) is securely attached to the doorframe (60) with fasteners. One side of the glass panel (62) is inserted into the engaging recess (42) and clamped between the resilient plates (46). The pushing bolts (45) are screwed into the pushing threaded holes (44) and push against the pushing plate (47). Consequently, the resilient plates (46) tightly grip the glass panel (62), such that the glass panel (62) is securely held in the engaging recess (42) in the door bracket (40).

Accordingly, to define any notch in the glass panel (62) for engaging with the hinge is unnecessary, and to assemble the hinge onto the glass door is easy and convenient and the cost for the same is reduced.

With reference to FIGS. 1 to 3, the at least one positioning device (26) is mounted between the securing base (20) and the spindle (30) to position the glass panel (62) in a specific position. In a preferred embodiment, the hinge has two positioning devices (26) mounted in the securing base (20). Each positioning device (26) comprises a positioning threaded hole (24), an inner cap (262), a biasing member (264) and an outer plug (266). Two positioning flats (32) are formed on the spindle (30) and face opposite directions. The positioning threaded hole (24) is defined in one end of the securing base (20) and communicates with the spindle hole (22). The inner cap (262) is mounted inside the positioning threaded hole (24). The biasing member (264) is mounted inside the positioning threaded hole (24) and presses against the inner cap (262). The outer plug (266) is screwed into the positioning threaded hole (24) to close the positioning threaded hole (24) and to hold the inner cap (262) and the biasing member (264) inside the positioning threaded hole (24). The inner cap (262) selectively abuts the respective positioning flat (32) of the spindle (30).

With the positioning devices (26), the glass panel (62) is held in a closed position by the inner caps (262) pressing respectively against the positioning flats (32) on the spindle (30). Pulling or pushing the glass panel (62) will open the glass door and will pivot the glass panel (62) and the spindle (30). The inner caps (262) slide respectively out of full contact with the positioning flats (32) and compress the biasing member (264). The compressed biasing member (264) presses the inner caps (262) such that the spindle (30) is caused to rotate until the inner caps (262) are in full contact with the positioning flats (32) again, such that the glass door will automatically close.

Figure 5:
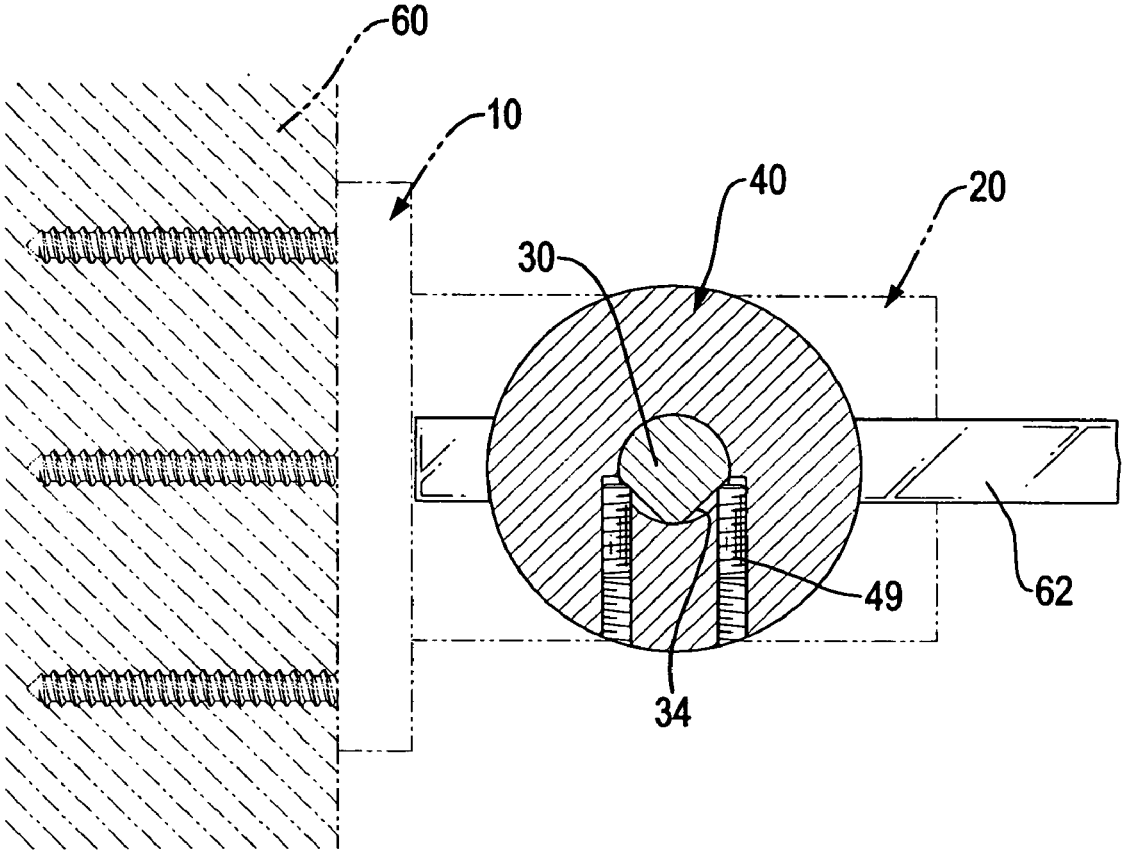
FIG. 5 is a top view in partial section of the glass door with the adjustable hinge along line 5—5 in FIG. 4.

With further reference to FIG. 5, the adjusting assembly is mounted between the door bracket assembly and the spindle (30) and comprises a holding device and an adjusting device. The holding device is mounted on the exterior surface of the spindle (30), and the adjusting device is mounted in the door bracket assembly and fits with the holding device on the spindle (30). In a preferred embodiment, the holding device comprises two inclined adjusting flats (34) defined in the exterior surface of the spindle (30), to form a V-like portion. The adjusting device comprises two adjusting threaded holes (48) and two adjusting screws (49). The threaded holes (48) are defined in the door bracket (40) and communicate with the spindle hole in the door bracket (40). The adjusting screws (49) are screwed respectively into and held respectively in the adjusting threaded holes (48), and each adjusting screw (49) has an inside end abutting one of the inclined adjusting flats (34) on the spindle (30).

The adjusting screws (49) are used to deflect the closed position of the glass panel (62) relative to the doorframe (60) to align the glass panel (62) with the doorframe (60) when the glass panel (62) is askew. Screwing one of the adjusting screws (49) into the corresponding threaded hole (48) and backing the other adjusting screw (49) out of the corresponding threaded hole (48) causes the inside ends of the adjusting screws (49) that respectively abut the inclined adjusting flats (34) to change the angular position of door bracket (40) relative to the spindle (30). The closed position of the glass panel (62) can be adjusted a particular amount, and exact alignment of the glass panel (62) with the doorframe (60) can be accomplished by means of the adjusting screws (49).

Figure 6:
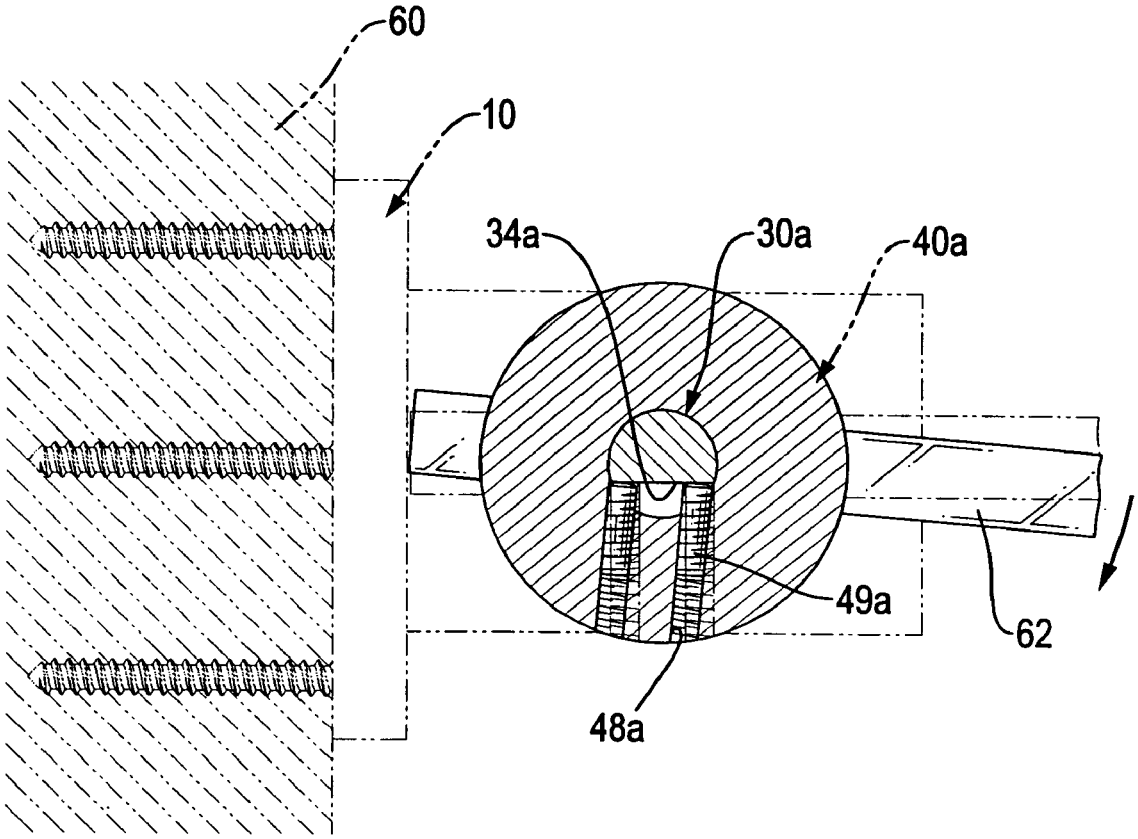
FIG. 6 is a top view in partial cross section of a glass door with a second embodiment of an adjustable hinge in accordance with the present invention.

With reference to FIG. 6, in a second embodiment, the holding device of the adjusting assembly comprises an adjusting flat (34*a*) defined in the exterior surface of the spindle (30). The adjusting device comprises two adjusting threaded holes (48*a*) and two adjusting screws (49*a*). The threaded holes (48*a*) are defined in the door bracket (40*a*) and communicate with the spindle hole in the door bracket (40*a*). The adjusting screws (49*a*) are screwed respectively into and held respectively in the adjusting threaded holes (48*a*), and each adjusting screw (49*a*) has an inside end abutting the adjusting flat (34*a*) on the spindle (30*a*).

The adjusting screws (49*a*) are used to deflect the closed position of the glass panel (62) relative to the doorframe (60) to align the glass panel (62) with the doorframe (60) when the glass panel (62) is askew. Screwing one of the adjusting screws (49*a*) into the corresponding threaded hole (48*a*) and backing the other adjusting screw (49*a*) out of the corresponding threaded hole (48*a*) causes the inside ends of the adjusting screws (49*a*) abutting the adjusting flat (34*a*) to change the angular position of the door bracket (40*a*) relative to the spindle (30*a*). Accordingly, exact alignment of the glass panel (62) with the doorframe (60) can be accomplished by means of the adjusting screws (49).

Figure 7:
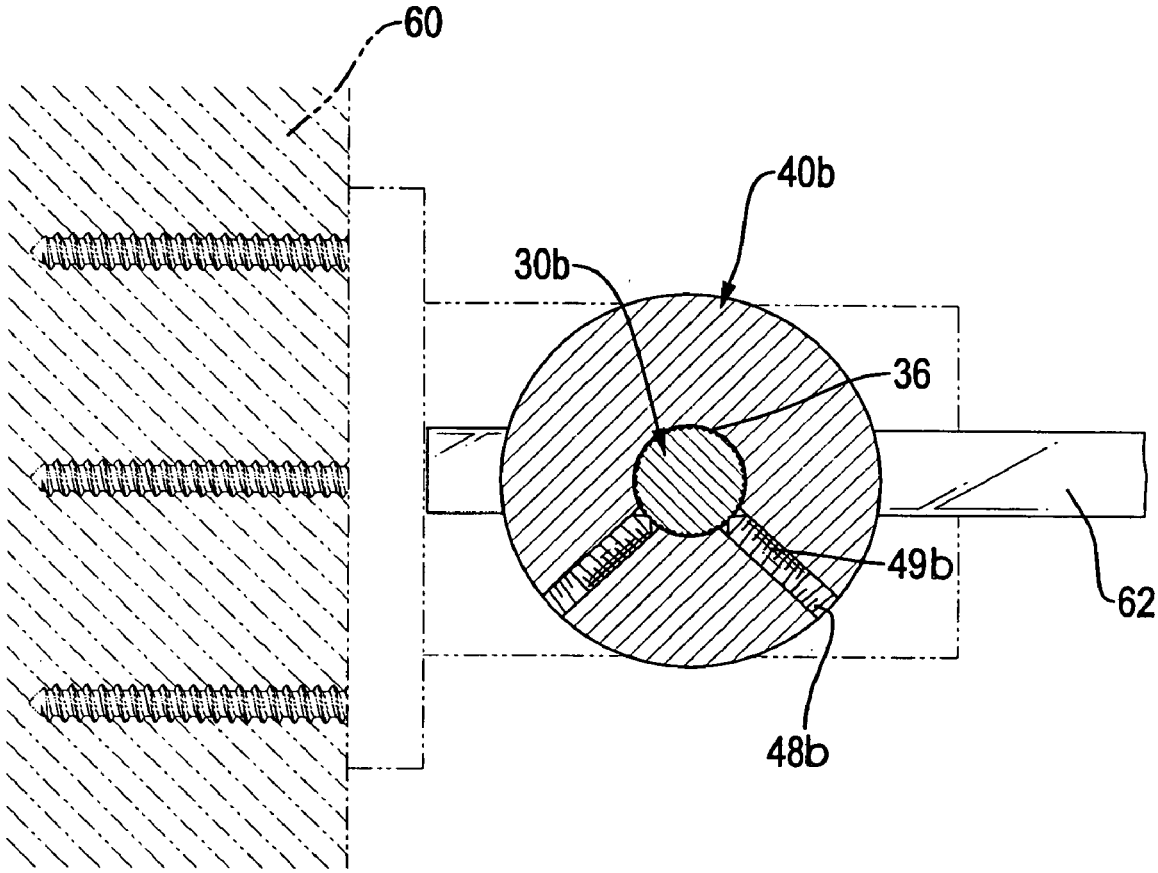
FIG. 7 is a top view in partial cross section of a glass door with a third embodiment of an adjustable hinge in accordance with the present invention.

With reference to FIG. 7, a third embodiment of the adjusting assembly is shown. The holding device of the adjusting assembly comprises multiple teeth (36) formed around the middle portion of the exterior surface of the spindle (30*b*). The adjusting device of the adjusting assembly comprises two threaded holes (48*b*) and two adjusting screws (49*b*). The threaded holes (48*b*) are defined in the door bracket (40*b*) and communicate with the spindle hole in the door bracket (40*b*). The adjusting screws (49*b*) are screwed respectively into and held in the threaded holes (48*b*), and each adjusting screw (49*b*) has an inside end abutting one of the teeth (36) on the spindle (30*b*).

With the engagement of the adjusting screws (49*b*) and the teeth (36) on the spindle (30*b*), the spindle (30*b*) will held in place relative to the door bracket (40*b*).

When the glass panel (62) does not exactly align with the doorframe (60), the adjusting screws (49*b*) are rotated to back out of the corresponding threaded holes (48*b*). Consequently, the door bracket (40*b*) can be rotated relative to the spindle (30*b*) to change the angular position of the door bracket (40*b*) with the glass panel (62) relative to the doorframe (60), such that exact alignment of the glass panel (62) with the doorframe (60) can be accomplished after the adjusting screws (49*b*) reengage with the teeth (36) on the spindle (30*b*).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A non-glass-cutting and adjustable automatic positioning hinge for a glass door and the adjustable hinge comprising:

a doorframe mount;

a securing base securely attached to the doorframe mount;

a spindle mounted in the securing base and having an exterior surface;

a door bracket assembly pivotally connected to the securing base with the spindle to attach to a glass panel of the glass door and comprising a door bracket constructed of a single body;

an engaging recess defined in the door bracket to hold the glass panel and having two sides;

two resilient plates mounted inside the engaging recess and located respectively at the sides of the engaging recess;

a pushing plate mounted inside the engaging recess and abutting against one of the resilient plates;

multiple pushing threaded holes defined in the door bracket, communicating with the engaging recess and corresponding to the pushing plate; and multiple pushing bolts screwing respectively into the pushing threaded holes and pushing against the pushing plate;

at least one positioning device mounted between the securing base and the spindle to position the glass panel in a specific position; and an adjusting assembly mounted between the door bracket assembly and the spindle and comprising a holding device mounted on the exterior surface of the spindle; and an adjusting device mounted in the door bracket and fitting with the holding device on the spindle.

2. The non-glass-cutting and adjustable automatic positioning hinge as claimed in claim 1, wherein the securing base has a spindle hole to rotatably hold one end of the spindle inside the spindle hole; and the door bracket has a spindle hole to hold the other end of the spindle.

3. The non-glass-cutting and adjustable automatic positioning hinge as claimed in claim 2, wherein each one of the at least one positioning device comprises a positioning threaded hole defined in one end of the securing base and communicating with the spindle hole in the securing base;

an inner cap mounted inside the positioning threaded hole;

a biasing member mounted inside the positioning threaded hole and pressing against the inner cap;

an outer plug screwed into the threaded hole to close the positioning threaded hole and to hold the inner cap and the biasing member inside the positioning threaded hole; and a positioning flat defined in the exterior surface of the spindle and selectively abutting with the inner cap.

4. The non-glass-cutting and adjustable automatic positioning hinge as claimed in claim 3, wherein the holding device of the adjusting assembly comprises two inclined adjusting flats defined in the exterior surface of the spindle; and the adjusting device of the adjusting assembly comprises two adjusting threaded holes defined in the door bracket and communicating with the spindle hole in the door bracket; and two adjusting screws screwing respectively into and held in the adjusting threaded holes and each having an inside end abutting one of the inclined adjusting flats on the spindle.

5. The non-glass-cutting and adjustable automatic positioning hinge as claimed in claim 3, wherein the holding device of the adjusting assembly comprises an adjusting flat defined in the exterior surface of the spindle; and the adjusting device of the adjusting assembly comprises two adjusting threaded holes defined in the door bracket and communicating with the spindle hole in the door bracket; and two adjusting screws screwing respectively into and held in the adjusting threaded holes and each having an inside end abutting the adjusting flat on the spindle.

6. The non-glass-cutting and adjustable automatic positioning hinge as claimed in claim 3, wherein the holding device of the adjusting assembly comprises multiple teeth formed around the exterior surface of the spindle; and the adjusting device of the adjusting assembly comprises two threaded holes defined in the door bracket and communicating with the spindle hole in the door bracket; and two adjusting screws screwing respectively into and held in the threaded holes in the door bracket and each having an inside end abutting one of the teeth on the spindle.

7. The non-glass-cutting and adjustable automatic positioning hinge as claimed in claim 2, wherein the holding device of the adjusting assembly comprises two inclined adjusting flats defined in the exterior surface of the spindle; and the adjusting device of the adjusting assembly comprises two adjusting threaded holes defined in the door bracket and communicating with the spindle hole in the door bracket; and two adjusting screws screwing respectively into and held in the adjusting threaded holes and each having an inside end abutting one of the inclined adjusting flats on the spindle.

8. The non-glass-cutting and adjustable automatic positioning hinge as claimed in claim 2, wherein the holding device of the adjusting assembly comprises an adjusting flat defined in the exterior surface of the spindle; and the adjusting device of the adjusting assembly comprises two adjusting threaded holes defined in the door bracket and communicating with the spindle hole in the door bracket; and two adjusting screws screwing respectively into and held in the adjusting threaded holes and each having an inside end abutting the adjusting flat on the spindle.

9. The non-glass-cutting and adjustable automatic positioning hinge as claimed in claim 2, wherein the holding device of the adjusting assembly comprises multiple teeth formed around the exterior surface of the spindle; and the adjusting device of the adjusting assembly comprises two threaded holes defined in the door bracket and communicating with the spindle hole in the door bracket; and two adjusting screws screwing respectively into and held in the threaded holes in the door bracket and each having an inside end abutting one of the teeth on the spindle.

* * * * *